United States Patent [19]

Dawson et al.

[11] 3,956,199

[45] May 11, 1976

[54] DISHWASHING COMPOSITIONS

[75] Inventors: Peter Leonard Dawson, Chester; Michael Tom Rothwell, Bromborough, both of England

[73] Assignee: Lever Brothers Company, New York, N.Y.

[22] Filed: Nov. 14, 1973

[21] Appl. No.: 415,709

[30] Foreign Application Priority Data

Nov. 22, 1972 United Kingdom ..... 54109/72

[52] U.S. Cl. ..... 252/545; 252/546; 252/548; 252/DIG. 14; 252/DIG. 17

[51] Int. Cl.[2] ..... C11D 1/02; C11D 1/66; C11D 3/26

[58] Field of Search ..... 252/545, 142, 143, 548, 252/DIG. 10, DIG. 15, DIG. 14, DIG. 17

[56] References Cited

UNITED STATES PATENTS

| | | | |
|---|---|---|---|
| 3,832,396 | 8/1974 | Irani et al. | 252/545 X |
| 3,833,517 | 9/1974 | Kling et al. | 252/545 |
| 3,853,781 | 12/1974 | Haschke et al. | 252/DIG. 15 |

FOREIGN PATENTS OR APPLICATIONS

| | | | |
|---|---|---|---|
| 247,699 | 12/1960 | Austria | 252/DIG. 15 |

*Primary Examiner*—Thomas J. Herbert, Jr.
*Attorney, Agent, or Firm*—James J. Farrell

[57] ABSTRACT

A detergent composition suitable for hand dishwashing and in particular for aluminium pan cleaning which has a pH of from 4 to 8.5 and consists of the following essential components: from 10 to 50% by weight of a detergent, from 5–40% of which is a calcium/magnesium sensitive anionic synthetic detergent; at least 1% of a solubiliser and 0.015–0.45% of an organic phosphonate. When used at dilutions of about 5x, the compositions can provide anti-resoiling effects on aluminium.

7 Claims, No Drawings

DISHWASHING COMPOSITIONS

Our earlier British patent application Ser. No. 47675/72 describes hand dishwashing compositions which yield (i) defined foam performance and good detergency when used for conventional hand dishwashing, i.e. in dilute (~500x dilution) conditions and (ii) cleaning and an anti-resoiling film on aluminium or aluminium alloy articles when used at ~5x and less dilution.

In the latter usage, viz. topical application to dirty pans they both clean very efficiently and impart anti-resoiling properties. Aluminium surfaces, in particular, are found to be remarkably easy to clean, following subsequent cooking of "problem" foods such as scrambled egg, porridge, custard, soup and fruit and fried eggs, sausages and tomatoes. The effect is most noticeable when these foods have accidentally been allowed to overcook or burn onto the insides of the utensils.

The anti-resoiling agents, i. e. the agents responsible for the anti-resoiling film effect, described in the earlier patent application were alkyl phosphate monoesters.

Improved hand dishwashing compositions having the foregoing attributes have now been found. Additional attributes of reduced anti-foaming effects due to the anti-resoiling agent, together with surface films of greater durability can be obtained. Furthermore, the compositions of the present invention allow a greater flexibility in compositional pH leading to more nearly neutral washing solutions and hence reduced incidence of attack on acid-sensitive surfaces encountered during washing-up and general cleaning.

Accordingly, the present invention provides a hand dishwashing and aluminium pan cleaning composition which comprises 10–50% total active detergent of which 5–40% is calcium/magnesium sensitive anionic synthetic detergent; 1–40% of a solubiliser, 0–25% being nonionic solubiliser; the total solubiliser being at least 1%; 0.015–0.45% organic phosphonate as herein defined; 0–5% pH controller, and the composition adjusted to a pH in the range 4–8.5, with a suitable acid or base.

The organic phosphonates herein defined (as anti-resoiling agent) are derived from the following acids:

(1)

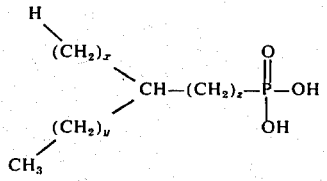

wherein $x + y + z = 8–16$, $x$, $y$ or $z$ may be zero, preferably $x = \mathbf{O}$, $y + z = 10–12$; and $z = \mathbf{O}$, $\mathbf{x + y} = 12–14$.

(2)

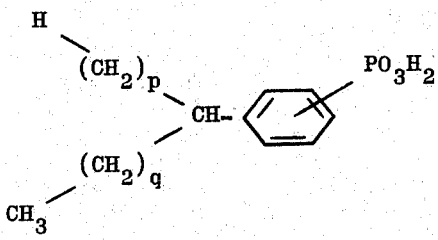

wherein $p + q = 8–14$, $p$ or $q$ may be zero, preferably $p = O$, $q = 10–12$.

(3a)

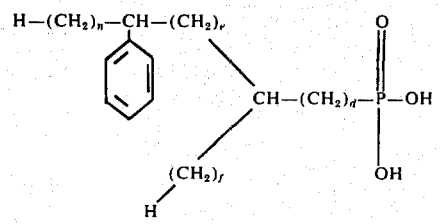

wherein $n + d + e + f = 8–14$, $n$, $d$, $e$ or $f$ may be zero, preferably $d = O$, $n + e + f = 10–12$.

(3b)

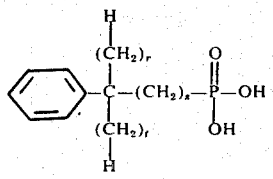

wherein $r + s + t = 8–14$, $r$, $s$ or $t$ may be zero, preferably $s = 0$, $r + t = 10–12$.

(4)

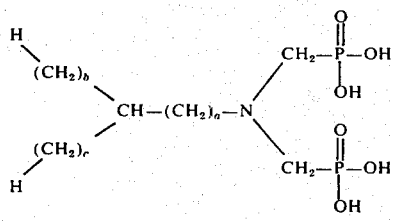

wherein $a + b + c = 10–17$, $a$, $b$ or $c$ may be zero, preferably $b = \mathbf{O}$, $a + c = 11–15$.

Suitable organic phosphonates are the alkyl ($C_{10}$–$C_{16}$) mono-1-phosphonates, the alkyl ($C_{12}$–$C_{16}$) random monophosphonates, the alkyl substituted ($C_{11-15}$) alkyl benzene random monophosphates and the $C_{12}$ allyl benzene (ring substituted) ring substituted monophosphonates and the alkyl ($C_{12-16}$) imino dimethylene phosphonates.

The phosphonates of the present invention are made by well known processes, usually the phosphochlorination of paraffins or alkyl benzenes followed by distillation and hydrolysis (Graf method), or by treatment of chloro-derivatives of the alkyl moieties with phosphorus trichloride and aluminium chloride followed by hydrolysis (Clay method).

The organic phosphonates of the invention are used preferably in their mono-salt form i.e. sodium, potassium, ammonium or substituted ammonium half salts.

Crude reaction products may contain ~50% monophosphonate and ~50% polyphosphonated material. The latter material in no way interferes with the anti-resoiling action and gives no appreciable anti-resoiling effects itself. It may impart some beneficial effects to the anti-resoiling system and to foam stability in very hard waters or those heavily contaminated with other heavy metal ions e.g. and Fe. It is however not an essential ingredient.

It is believed that the above alkyl and alkyl benzene phosphonates are more surface active and capable of bonding more strongly to the aluminium surface. They will therefore operate more efficiently at lower levels in compositions containing high levels of interfering foaming coactives. Furthermore, their use as anti-resoiling agents can considerably reduce the "temporary" nature of the surface film making retreatment at frequent intervals unnecessary.

This greater durability of film is obtained when careful selection of the pH conditions, anionic coactives and anti-resoiling agent is made.

Compositions of the invention give satisfactory foam characteristics in dilute solutions (500x dilution) when tested by the following laboratory method:

An "acceptable" foam performance is now believed to be at least 60% of the performance of a currently marketed "premium" product of 40% total active detergent material, consisting essentially of sodium dodecyl benzene sulphonate, sodium lauryl ether (3EO) sulphate and coconut monoethanolamide in the weight ratio 1:1:0.1, on any test method for foam and foam stability on an active detergent weight for weight basis. The preferred test for foam and foam stability in presence of food residues is a modified Schlachter-Dierkes test which is based on the principle described in Fette und Seifen, 1951, vol. 53, p. 207. A 100 ml aqueous solution of the dishwashing composition containing 0.06% active detergent in water of 24°H at 45°C is rapidly agitated using a vertically oscillating perforated disc within a graduated cylinder. The initial foam volume is recorded.

0.2 g of soil (9.5 parts commercial cooking fat, ¼ part oleic acid, ¼ part stearic acid dispersed in 120 parts water, the emulsion stabilised with 10 parts of what starch) is added and the solution mildly agitated with the perforated disc for 10 seconds to disperse it. This is followed by a 5 seconds rest, after which a further aliquot of soil is added and the process repeated until the foam is exhausted, i.e. incomplete coverage of the surface of the solution by foam. The number of soil increments required to exhaust the foam is recorded. The control liquid gives a score of 50 ±3 increments, and an initial foam of 240 ml. The incremental scores of the compositions of the present invention are expressed as a percentage of this and are consequently at least 30 increments.

Compositions of the invention satisfy the following anti-resoiling test:

The inside surface of a 5" diameter aluminium pan is prepared by scouring in warm tap water with a non-woven nylon fleece impregnated with mineral abrasive until the surface is completely wetted by the water. The pan is then dried with a paper tissue, and soiled in the following manner:

25 ml of an egg/milk mixture of ratio 50:50 by volume is poured into the pan in the usual way. The mixture is cooked without stirring for 1½ minutes on an electric hot plate maintained at 200°–300°C. Under these conditions the egg/milk mixture leaves a coherent light brown residue adhering to the pan when the loose bulk of the cooked mixture has been scraped out with a wooden spoon.

The solution under test is introduced directly into the utensil (6 ml of a 30% w/w aqueous solution of the composition — this approximates to 2 mls composition in neat form added to a wet pan). The pan is then scoured clean (about 30–60 seconds) with the abrasive fleece, rinsed, dried and resoiled with the egg/milk mixture.

The pan is then immersed in a 0.15% solution of the composition for 30 seconds and a soft polyurethane sponge is used to attempt complete removal in 15 seconds.

Compositions of this application will cause the egg-/milk residue to be removable with the sponge in 15 seconds or less following three or fewer treatment-/cooking cycles. The egg/milk mixture is selected for the anti-resoiling performance test because it is a soil known to be difficult to remove in hand dishwashing.

The compositions of the present application are effective in providing an anti-resoiling film when pans in which porridge, milk pudding, milk, fried eggs, sausages etc. or gravy has been cooked, are washed/-cleaned therewith. Equally, the film will be provided on pans which are relatively clean, e.g. those in which potatoes have been boiled.

The durability of the films provided by the compositions of the present invention when used at the 5x or less dilution is demonstrated by the following test.

The pan which has been precleaned, soiled and washed with a sponge to give a score of three or fewer cook/ wash cycles for 15 seconds removal is further subjected to resoiling and cleaning with a sponge using a dilute (500x) solution of the composition under test in water. This operation is repeated until the soil cannot be removed from the utensil with the sponge in 15 seconds or less. The number of further cook/wash cycles required to reach this stage is taken to be a measure of the durability of the surface. Scores of at least 1 are attained by the compositions of the present invention.

Compositions containing the minimum levels of anti-resoiling agent consistent with satisfaction of the anti-resoiling test usually give durability scores of ~2. Higher levels of anti-resoiling agent in compositions increase the durability considerably until at about five times the minimum effective level, the durability scores reach a maximum of about 20 (cook/wash cycles), thereafter increasing no more with increased anti-resoiling agent level.

Compositions of the present invention comprise 10–50% total active detergent. When used at the 5x or less dilution, for cleaning and anti-resoiling effects, the concentration of detergent is preferably about 5–25% w/w, and the pH is substantially that of the composition. It is surprising that the minimum effective level of the organic phosphonate effective for a score of 3 or less cook/wash cycles on the anti-resoiling test specified herein, is independent of the total anionic detergent.

The content of organic phosphonate is 0.01–0.45% by weight of total composition. The lower limit is determined by satisfaction of the anti-resoiling test and the upper limits is that beyond which no improvement in anti-resoiling or in durability of film is attained. The minimum effective level appears independent of the total active detergent content.

Care is required in selection of the synthetic detergent components. Cationic surfactants, carboxylic anionic surfactants and nonionics of low HLB value are unsuitable as they tend to interfere with the reaction of anti-resoiling agent with aluminium surfaces.

Binary or ternary systems should be selected to contain a calcium and magnesium ion sensitive anionic synthetic detergent and a solubiliser which is either anionic or nonionic. The solubiliser is important in that it (a) ensures that the anti-resoiling agent, which is characteristically of limited aqueous solubility, is in solution during use and (b) promotes the foaming properties of the calcium and magnesium ion sensitive synthetic detergent, particularly in hard water use conditions.

Suitable calcium and magnesium sensitive anionic synthetic detergents are alkali metal, ammonium or substituted ammonium derivatives of the $C_{11-18}$ alpha and random alkene sulphonates; random $C_{13}$-$C_{18}$ alkyl sulphonates; $C_{10}$-$C_{15}$ alkyl benzene sulphonates; $C_{11}$-$C_{15}$ primary or secondary alcohol sulphates and binary or ternary mixtures, thereof. Commercial "olefin sulphonates" contain alkene sulphonate in conjunction with hydroxy alkane sulphonates and disulphonates. The first material is a calcium and magnesium sensitive anionic synthetic detergent, whereas the latter two are anionic solubilisers, as explained below.

A solubiliser is particularly necessary in hard water use conditions. A solubiliser is defined as a surface active agent which will form clear solutions in hard water of 24°H at neutral pH in the temperature range 20°–45°C at concentration of 0.05% solubiliser. At least 1.0% by weight of the compositions of the present invention is a solubiliser. Suitable solubilisers are soluble nonionic or anionic compounds of medium to high HLB (W C Griffin, J Soc Cosmetic Chemists, 1, page 311, 1949). The following list indicates suitable materials.

Nonionic Solubilisers

1. Primary and secondary aliphatic alcohols and vicinal diols of chain length of 10–16 carbon atoms with an average of 7–20 mols ethylene oxide per mol of alcohol/diol. 2. Alkyl phenols of alkyl chain lengths 8–12 carbon atoms with an average of 7–20 mols ethylene oxide per mol alkyl phenol.

Anionic Solubilisers

1. The alkali metal, ammonium or substituted ammonium hydroxyalkane sulphonates and disulphonates resulting from sulphonation of $C_{11-18}$ random and alpha-olefins. These are usually present in commercial "olefin sulphonate".

2. Alkali metal, ammonium or substituted ammonium $C_{11}$-$C_{15}$ primary or secondary alcohol ether ($\overline{1}$–$\overline{12}$ EO) sulphates. (1–12 EO signifies that the molecule contains, on average, from 1–12 ethylene oxide units).

Preferred solubilisers are $C_{11}$–$C_{15}$ secondary alcohol $\overline{12}$ EO nonionic, $C_{11}$–$C_{15}$ secondary alcohol $\overline{7}$ EO sulphate, $C_{12}$–$C_{15}$ synthetic primary alcohol $\overline{3}$ EO sulphate, and the solubiliser component of commercial alpha- and random $C_{14}$–$C_{16}$ olefin sulphonates. These enhance the foam performance.

Sufficient pH controller must be incorporated to ensure the correct pH in the pan during cleaning and treatment. In order to avoid too high a pH of cleaning/treating solution when neutral or slightly alkaline compositional pH's are employed when, for instance, highly alkaline waters are used as diluent, pH controllers in the range 7–8.5 are desirable. These may be, for example, tris (hydroxymethyl) aminomethane, triethanolamine, phosphoric acid (in small quantities), o-aminobenzoic acid, 2,4,6, -chlorophenol.

Suitable acids or bases are those having at least one pKa in the range 6–8. They may be used in their free form or partially dissociated or protonated by adjusting the final pH of the composition to that desired. Compositions to be used in neutral or acid waters may contain no added pH controller if conditions so dictate.

The preferred pH range viz. 5–7 is obtained by incorporating weak organic acids whose pKa lies in the range 3–6 and adjusting to pH to that desired with NaOH, ammonia or substituted ammonia derivatives. The amount of pH controller depends on the type of water encountered, the pH of the composition desired, and the acid reserve of the particular acid selected. Usually, 0.1–5% by weight of the composition is required. 0.5–2.5% is preferred.

In most cases, there is insufficient acid in the compositions to alter significantly the dilute washing solution pH from that of the naturally occurring water, and as such has only small effect upon the foam performance. Where the pH of the dilute solution is significantly lowered below 7, for example in soft waters, then the foam performance is increased.

Suitable acids, when used, are those having at least one pKa in the range 3–6. Preferred acids are malonic, succinic, glutaric, citric, tartaric, and lactic. Phthalic, adipic, fumaric and benzoic acids are less soluble and suitable for use in aqueous suspensions or pastes, or powders.

They may be used as mixtures or as single components in their acid form or partial alkali metal/ammonium/amine salts.

The effect of pH in use on the durability of the anti-resoiling film has been demonstrated on a typical composition according to the invention, viz. 4:1 ratio of sodium dodecylbenzene sulphonate and sodium alkyl ($C_{12-15}$) ether (3 ethylene oxide) sulphate, 2% succinic acid, 0.3% n-$C_{12}H_{25}$ 1-phosphonate (total active detergent 40%), water, and 0.880 ammonia for pH adjustment;

| | | preferred | | | | |
|---|---|---|---|---|---|---|
| pH of composition in use | 4 | 5 | 6 | 7 | 8 | 9 |
| Durability | 20 | 19 | 14 | 9 | 4 | 0 |

The preferred compositions of the invention comprise 30–45% total active detergent of which 15–35% is a calcium/magnesium sensitive anionic synthetic detergent, 5–20% total solubiliser, 0.03–0.3% organic phosphonate, 0.5–2% pH controller, pH of compositions being 5–7.

Suitable dilutions in use are 10–50% by weight of the composition in water for pan washing and 0.1–0.2% for conventional dishwashing in the bowl.

It will be appreciated that the nature of the soil in the dirty pan during treatment will have to a certain extent an effect upon the anti-resoiling efficiency of the washing solution. Proteinaceous foods e.g. milk, interfere to a slightly greater extent than fatty or farinaceous matter. The latter foods hardly interfere at all, unless they are present in unreasonably high quantities, and are comparable in their effect to an essentially clean pan.

The minimum effective levels of organic phosphonate are found to be slightly lower for treatment of clean or fatty soiled pans, than are required for proteinaceous-soiled pans, e.g. a minimum effective level for a given phosphonate may be 0.015 and 0.02% respectively.

The compositions may include a balance of inert filler, e.g. sodium sulphate, polyethylene glycol, for powdered or paste compositions, or water, hydrotropes, viscosity modifiers, opacifiers etc. for liquid compositions. All may contain perfume, colourants, fruit juices etc.

Compositions of the invention may be in powder form, made substantially by replacing the water and hydrotropes of the examples with sodium sulphate or other soluble inert filler. The less soluble crystalline pH controllers described above may be employed if desired.

They may also be prepared in paste form by replacing some or all of the water and hydrotropes with a soluble plastic material such as polyethylene glycol or sodium sulphate paste. Alternatively some or all of the water and hydrotrope may be excluded completely, thereby forming a concentrated paste of the essential ingredients. The ratios of the essential ingredients to each other are as described in this specification and the active detergent material will approach 50%.

Optionally, the paste can be injected or otherwise incorporated within abrasive or non-abrasive fleeces, wools or sponges of respectively nylon, steel or copper, and polyurethane, or any mixture thereof.

The physical form of the compositions affect neither the foam performance nor the anti-resoiling efficiency.

The invention will now be further described by way of Examples.

EXAMPLES 1–12

A composition consisting of a 4:1 ratio of sodium dodecyl benzene sulphonate and sodium alkyl ($C_{12-15}$)ether (3 ethylene oxide) sulphate, 2% succinic acid, the organic phosphonate specified below, was made up to a 40% total active detergent (excluding the phosphonate) level with water and the pH adjusted to pH 5 with ammonium hydroxide. The minimum effective level (MEL) of the organic phosphonate critical for anti-resoiling effect, viz. an anti-resoiling score on the test herein described, of 3 cycles was determined and shown to be as follows; as % by weight of total composition.

| Ex. No. | Phosphonate | | MEL (as 100% phosphonate) % |
|---|---|---|---|
| 1 | n-$C_{10}H_{21}$-$PO_3H_2$ | -1-phosphonate | 0.090 |
| 2 | n-$C_{12}H_{25}$-$PO_3H_2$ | -1-phosphonate | 0.025 |
| 3 | n-$C_{14}H_{29}$-$PO_3H_2$ | -1-phosphonate | 0.020 |
| 4 | n-$C_{16}H_{33}$-$PO_3H_2$ | -1-phosphonate | 0.080 |

-continued

| Ex. No. | Phosphonate | | MEL (as 100% phosphonate) % |
|---|---|---|---|
| 5 | n-$C_{12}H_{25}$-$PO_3H_2$ | - random | 0.090 |
| 6 | n-$C_{14}H_{29}$-$PO_3H_2$ | - random | 0.030 |
| 7 | n-$C_{16}H_{33}$-$PO_3H_2$ | - random | 0.065 |
| 8 | n($C_{11}$-$C_{15}$) alkyl benzene $PO_3H_2$ (alkyl substituted) | | 0.035 |
| 9 | n-$C_{12}$ alkyl benzene $PO_3H_2$ (ring substituted) | | 0.090 |
| 10 | n-$C_{12}H_{25}$ N $(CH_2PO_3H_2)_2$ | | 0.095 |
| 11 | n-$C_{14}H_{29}$ N $(CH_2PO_3H_2)_2$ | | 0.050 |
| 12 | n-$C_{16}H_{33}$ N $(CH_2PO_3H_2)_2$ | | 0.065 |

Durability data on the compositions of the Examples 2, 5, 7, and 10 as measured by the test hereindescribed was determined:

| Level of phosphonate in composition % | Ex. 2 | Ex. 5 | Ex. 7 | Ex. 10 |
|---|---|---|---|---|
| 0.04 | 8 | 0 | 0 | 0 |
| 0.06 | 12 | 0 | 1 | 0 |
| 0.08 | 15 | 0 | 4 | 0 |
| 0.10 | 18 | 2 | 7 | 2 |
| 0.20 | 19 | 11 | 14 | 10 |
| 0.30 | 19 | 14 | 17 | 13 |
| 0.40 | 19 | 17 | 18 | 16 |

Maximum durability is obtained at a level of phosphonate equivalent to about 5x the MEL.

All the foregoing compositions 1–12 gave satisfactory foam and detergency when used at the ~500x dilution.

The following compositions were made:

| Example No. | 13 | 14 | 15 | 16 | 17 |
|---|---|---|---|---|---|
| Sodium dodecyl benzene sulphonate | 30 | — | — | 27 | 22 |
| Sodium $C_{13}$-$C_{18}$ secondary alkane sulphonate | — | 15 | 28 | — | — |
| Solubiliser | | | | | |
| Ammonium $C_{12}$-$C_{15}$ primary alcohol sulphate | 9 | 14 | 12 | 13 | 22 |
| Anti-resoiling agent | | | | | |
| n-$C_{12}H_{25}$ 1-monophosphonate | 0.1 | — | — | 0.2 | 0.2 |
| n-$C_{12}H_{25}$ random monophosphonate | — | 0.4 | — | — | — |
| n-($C_{11}$-$C_{15}$) alkyl benzene random monophosphonate | — | — | 0.2 | — | — |
| pH controller | | | | | |
| Succinic acid | 2 | 1 | — | — | — |
| Glutaric acid | — | 1 | 2 | — | — |
| Triethanolamine | — | — | — | 2 | — |
| pH | | | | | |
| .880 $NH_4OH$ to pH:- | (5) | (5) | (6) | (7.5) | (7) |
| Hydrotrope/viscosity modifier | | | | | |
| Ethanol | 6 | 4 | 7 | 5 | 8 |
| Gelatin | 1 | 1 | 1½ | ¾ | 2 |
| Water | | | (to 100%) | | |

At 0.06% total a.d. in solution (24°H temporary water) the compositions all gave foam performance scores > 75% of the "currently marketed premium product". Anti-resoiling tests gave the following data:

| | | 13 | 14 | 15 | 16 | 17 |
|---|---|---|---|---|---|---|
| Anti-resoiling test - | treatment/ cooking cycles | 1 | 1 | 1 | 1 | 1 |
| Durability test | | 19 | 17 | 10 | 6 | 6 |

What is claimed is:

1. A detergent composition suitable for hand dishwashing having a pH in the range 4–8.5 comprising a. 10–50% by weight of an active detergent compound, of which 5–10% is calcium/magnesium sensitive anionic synthetic detergent
b. 1–40% by weight of a solubiliser, of which 0–25% is nonionic solubiliser
c. 0–5% by weight of a pH controller
d. an effective amount of an organic phosphonate derived from an acid selected from the group consisting of (1)

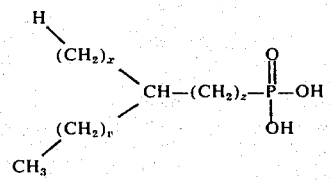

wherein $x + y + z = 8–14$ and the total number of carbon atoms is 10–16

(2)

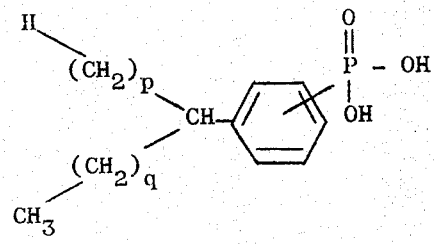

wherein $p + q = 3–7$ and the total number of carbon atoms is 11–15

(3a)

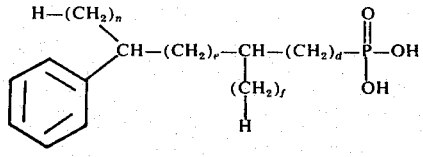

wherein $n + d + e + f = 8–14$ and the total number of carbon atoms is 16-22

(3b)

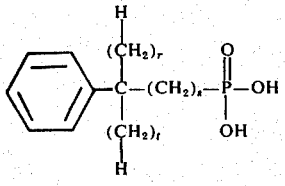

wherein $r + s + t = 8–14$ and the total number of carbon atoms is 15–21

(4)

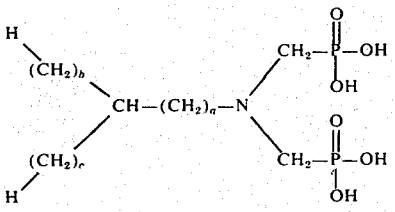

wherein $a + b + c = 11–15$ and the total number of carbon atoms in the alkyl group is 12–16.

2. A detergent composition according to claim 1 wherein the organic phosphonate comprises a $C_{10}$–$C_{16}$ alkyl mono-1-phosphonate.

3. A detergent composition according to claim 1 wherein the organic phosphonate is a $C_{12}$–$C_{16}$ alkyl random monophosphonate.

4. A detergent composition according to claim 3 wherein the organic phosphonate is a $C_{11}$–$C_{15}$ alkyl random monophosphonate.

5. A detergent composition according to claim 1 wherein the organic phosphonate is a $C_{12}$ alkyl benzene random monophosphonate.

6. A detergent composition according to claim 1 wherein the organic phosphonate is a $C_{12\text{-}16}$ alkyl imino dimethylene phosphonate.

7. A detergent composition according to claim 1 wherein the organic phosphonate is in the form of a mono- sodium, potassium, ammonium or substituted ammonium half salt.

* * * * *